US009392856B2

(12) United States Patent
Burnet et al.

(10) Patent No.: US 9,392,856 B2
(45) Date of Patent: Jul. 19, 2016

(54) HAIRNET

(71) Applicant: ABURNET LIMITED, Derbyshire (GB)

(72) Inventors: Richard John Stacey Burnet, Derbyshire (GB); Paul Parsons, Derbyshire (GB)

(73) Assignee: Aburnet Limited, Derbyshire (GB)

( * ) Notice: Subject to any disclaimer, the term of this patent is extended or adjusted under 35 U.S.C. 154(b) by 0 days.

(21) Appl. No.: 14/475,676

(22) Filed: Sep. 3, 2014

(65) Prior Publication Data

US 2015/0059799 A1 Mar. 5, 2015

(30) Foreign Application Priority Data

Sep. 4, 2013 (GB) ..... 1315750.8

(51) Int. Cl.
*A45D 8/40* (2006.01)

(52) U.S. Cl.
CPC ..... *A45D 8/40* (2013.01)

(58) Field of Classification Search
CPC ... A45D 8/40; A45D 2007/002; A42B 1/041; A42B 1/04; A42B 1/043; A42B 1/069; A42B 3/10; D05B 91/06; D04B 1/12; D04B 1/18; D04B 1/22; D04B 1/24; D04B 21/00; D04B 21/14; D04B 21/10; D04B 21/12; D04B 39/00; A41D 23/00; A41D 27/02; A41D 2500/10
USPC ..... 132/274, 201, 270, 54; 2/209.5, 184
See application file for complete search history.

(56) References Cited

U.S. PATENT DOCUMENTS

| | | | | | |
|---|---|---|---|---|---|
| 1,661,141 | A | | 2/1928 | Lipper | |
| 1,879,362 | A | | 9/1932 | Lipper | |
| 2,022,922 | A | | 12/1935 | Morins | |
| 2,101,734 | A | * | 12/1937 | Chapple | A42B 1/12 132/274 |
| 2,211,184 | A | * | 8/1940 | Varell | A42B 1/041 2/174 |
| 2,261,811 | A | * | 11/1941 | Saigh | A45D 8/40 132/274 |
| 2,329,478 | A | * | 9/1943 | Morins | A45D 8/40 132/274 |
| 2,329,676 | A | * | 9/1943 | Henry | A45D 8/40 132/274 |

(Continued)

FOREIGN PATENT DOCUMENTS

| | | | |
|---|---|---|---|
| EP | 0587361 | A2 | 3/1994 |
| GB | 387071 | A | 2/1933 |

(Continued)

*Primary Examiner* — Rachel Steitz
(74) *Attorney, Agent, or Firm* — Young Basile Hanlon & MacFarlane, P.C.

(57) ABSTRACT

A hairnet has a fabric comprising an elongated fan edge and an elasticated edge portion extending from a first end to a second end of the elongated fan edge around a peripheral edge of the fabric. The fabric is drawn together at a line of binding proximate the elongated fan edge. The hairnet comprises a strip of material at least partially covering the elongated fan edge. A method of producing a hairnet free of a cinch point includes providing a hairnet precursor bunched at a cinch point, positioning the hairnet precursor on a mount to splay fabric adjacent the cinch point of the hairnet precursor so that fabric is spread out over the mount with first and second edges of the fabric extending from each side of the cinch point, binding the fabric around a perimeter portion of the cinch point and removing the cinch point along a cutting line.

13 Claims, 9 Drawing Sheets

(56) References Cited

U.S. PATENT DOCUMENTS

| | | | | | |
|---|---|---|---|---|---|
| 2,345,396 | A * | 3/1944 | Hunter | A45D 8/40 | 132/274 |
| 2,346,796 | A * | 4/1944 | Shaw | A45D 8/40 | 132/274 |
| 2,475,320 | A * | 7/1949 | Herschensohn | A45D 8/40 | 132/274 |
| 2,483,927 | A * | 10/1949 | Oliner | A45D 8/40 | 132/274 |
| 2,524,255 | A * | 10/1950 | Goldsmith | A45D 8/40 | 132/274 |
| 2,579,089 | A * | 12/1951 | Price | A42B 1/041 | 132/274 |
| 2,638,102 | A | 5/1953 | Goldsmith | | |
| 2,742,910 | A | 4/1956 | Berg | | |
| 2,771,888 | A * | 11/1956 | Herschensohn | A45D 8/40 | 132/274 |
| 2,798,500 | A * | 7/1957 | Dietze | A45D 8/40 | 132/274 |
| 3,094,995 | A * | 6/1963 | Dietze | A45D 8/40 | 132/274 |
| 3,392,737 | A * | 7/1968 | Fefferman | A42B 1/041 | 132/274 |
| 3,750,681 | A * | 8/1973 | Claunch | A45D 8/40 | 132/274 |
| 4,781,291 | A | 11/1988 | VanGinhoven | | |
| 5,890,229 | A * | 4/1999 | Esposito | A42B 1/041 | 2/171 |
| 6,116,058 | A | 9/2000 | Diestel et al. | | |
| 6,434,752 | B1 * | 8/2002 | Adams | A42B 1/041 | 132/200 |
| 7,895,672 | B2 * | 3/2011 | Grey | A42B 1/041 | 2/171 |
| 2003/0106347 | A1 | 6/2003 | Kost | | |
| 2008/0053158 | A1 | 3/2008 | Willner et al. | | |
| 2011/0145976 | A1 | 6/2011 | Osgood | | |
| 2012/0132227 | A1 | 5/2012 | Dietze | | |

FOREIGN PATENT DOCUMENTS

| | | | |
|---|---|---|---|
| GB | 549196 | A | 11/1942 |
| GB | 565436 | A | 11/1944 |
| GB | 2501253 | A | 10/2013 |
| WO | 2012119624 | A1 | 9/2012 |

* cited by examiner

HAIRNET

CROSS REFERENCE TO RELATED APPLICATION

The present application claims priority to Great Britain Patent Application No. 1315750.8, filed Sep. 4, 2013, incorporated herein in its entirety.

TECHNICAL FIELD

The present invention relates to hairnets. In particular, the present invention relates to hairnets for use as headwear to restrain hair, especially with improved comfort for the user.

BACKGROUND

Hairnets may be used for a variety of purposes, for example in catering establishments and factories where foodstuffs are manufactured and/or packaged, or pharmaceutical or cosmetic manufacturing establishments where it is required that workers keep their hair covered at all times for reasons of hygiene. Other forms of headwear are also known for similar purposes; in the context of the embodiments herein the term "hairnet" should be understood to encompass all such headwear.

Hairnets may be made by a variety of processes in a number of styles according to the desired product type. Many styles include an elasticated material incorporated close to the edges of the fabric which can be stretched to mount the hairnet in position and which relaxes slightly when in position on the head but is under sufficient tension to hold the hair in position under the hairnet. In such styles, it is conventional to produce a continuous band of fabric, for example of woven or knitted cloth, with individual hairnets being made by crimping at two points (cinch points) corresponding to the front and back of the hairnet and cutting the hairnet so formed from the continuous band of fabric. In another method, the edges of a segment of material, commonly rectangular in shape, are drawn together into at least one cinch point where the material forming the hairnet is fastened into gathers or bunches. Accordingly, at the cinch point, the fabric of the hairnet is formed into a bunch or a lump accommodating excess material to allow a substantially rectangular fabric to fit snugly over the contours of the upper part of the head. Commonly, the hairnet is positioned on the head so that the cinch point is located at the nape of the neck and an optional second cinch point is located at the forehead.

Hairnets may also be worn in sporting events or other physical exercise to restrain the hair, for example to keep it out of the eyes, to hold it close to the head in a streamlined manner and/or to hold it off the face for appearance purposes. Often in such events, especially in equestrian events, it is necessary to wear a close fitting hard hat over the hairnet. On such occasions, it is uncomfortable for the wearer to have a lump of bunched material in the hairnet under a helmet.

SUMMARY

There has now been devised an improved hairnet which overcomes or substantially mitigates the above-mentioned and/or other problems associated with the prior art.

According to a first aspect, there is provided a hairnet comprising a fabric comprising an elongated fan edge and an elasticated edge portion extending from a first end of the elongated fan edge around a peripheral edge of the fabric to a second end of the elongated fan edge. The fabric of the hairnet is drawn together at a line of binding proximate the elongated fan edge, and the hairnet comprises a strip of material at least partially covering the elongated fan edge. The hairnet is free of a bunched cinch point.

The line of binding is a portion of the fabric at which excess fabric is drawn together to allow the fabric to fit snugly over the contours of the upper part of the head. The collection of the material together along the line of binding reduces the bulk of excess material at a single point and therefore significantly increases the comfort for the user. The fabric fans out evenly from the line of binding. The line of binding is situated adjacent the elongated fan edge and conveniently runs parallel thereto. The elasticated edge portion passing around the remaining peripheral edge of the hairnet serves to retain the hairnet securely on the head of the wearer.

The strip of material may of the same fabric or a different fabric of the hairnet, preferably the same material, especially a knitted material. The function of the strip of material is to reinforce the elongated fan edge. The strip of material may partially or fully cover the elongated fan edge according to the materials used and the desired appearance of the hairnet. Conveniently, the elongated fan edge is completely covered to strengthen the edge in use so that the occurrence of fraying or damage to the binding line is avoided. The cover fabric may be applied when the line of binding is applied to the fabric or it may be applied at a later stage. Also, this cover fabric can be used to strengthen the hold on the edge elastics at this join. The length of the strip will depend on the thickness of the fabric used but typically has a length of from 1 to 7 cm, preferably 4 to 6 cm. Further preferably, the elongated fan edge has a cover seam which is folded over & twisted over the edge and secured by stitching according to conventional methods.

In a second aspect, a method is provided of producing a hairnet free of a cinch point, the method comprising the steps of a) Providing a hairnet precursor having a cinch point, the hairnet precursor comprising fabric with an elasticated edge portion, wherein fabric of the hairnet precursor is bunched together at the cinch point;

b) Positioning the hairnet precursor on a mount to splay out fabric adjacent the cinch point so that fabric bunched together at the cinch point is spread out over the mount with a first and second edge of the fabric extending from each side of the cinch point;

c) Binding the fabric of the hairnet precursor in a line of binding extending around a perimeter portion of the cinch point from the first edge of the fabric to the second edge of the fabric; and d) Removing the cinch point along a cutting line located between the cinch point and the line of binding to form a hairnet comprising an elongated fan edge along the cutting line.

It has been found that a hairnet as defined has significantly reduced height and/or width of fabric bunching, and the resulting hairnets are much more comfortable to use by the wearer, particularly if worn under a hard helmet, for example as worn in equestrian or cycling events. In use, the elongated fan edge may be worn at the front over the forehead as it is soft and comfortable under a riding helmet, enabling a neat round finish to the rear for short haired riders, or the cover seam may be worn to the rear for longer hair styles where it is hidden under the bun of long hair to give a neat "show" appearance under a riding helmet. For traditional hairnets, this is important for typical older wearers as the skin thins out with age.

Hairnets according to the invention may be used in any environment in which it is generally desirable to wear a head covering. In particular, hairnets according to the invention may be used in environments in which it is important to maintain a high level of hygiene. For example, hairnets according to the invention may be used in catering establishments and factories where foodstuffs are manufactured and/or packaged, or pharmaceutical or cosmetic manufacturing establishments, or medical establishments. The hairnets may also be used in industrial situations in which avoidance of contamination by hair is critical, eg in paint spraying processes.

The present invention also provides a method of manufacturing a hairnet in which bulk occurring in a portion of the periphery or edge of the hairnet is reduced. The hairnet is substantially free from a bunched cinch.

In the first step in a method according to the present invention, a hairnet precursor with a cinch point is provided. The hairnet precursor comprises a fabric suitable for use on the head which combines good wearability properties with the ability to be retained on the head. Conveniently, the hairnet precursor is produced according to conventional hairnet manufacturing procedures from a length of fabric. The elasticated edge portion may include elasticated materials, stretch stitching and/or sewn with elasticated threads. The hairnet precursor comprises a fabric with an elasticated edge portion that extends through the cinch point, wherein fabric of the hairnet precursor is bunched together at the cinch point. The cinch point is a point at the edge of the fabric at which excess fabric is drawn together to allow the fabric to fit snugly over the contours of the upper part of the head. Typically, the hairnet precursor comprises one or two cinch points. In a preferred method according to the present invention, the hairnet precursor comprises a single cinch point.

The hairnet precursor is transformed by a method according to the invention into a hairnet in which the bulk of the bunched fabric of the cinch point is significantly reduced. Thus, the fabric of the hairnet precursor should be suitable for use as a hairnet. The use of a knitted fabric is advantageous as knitted fabrics, due to their structure, generally have a higher degree of elasticity than woven or other nonwoven fabrics. This enables the hairnet to stretch to an appropriate size and shape to snugly fit the user's head. This has two key effects: enabling a single size of hairnet to be worn by all users, and effectively gripping and containing the user's hair regardless of head size or hairstyle. The knitted fabric from which the hairnet precursor is produced may be made using any conventional method known to those skilled in the art. For example, the knitted fabric may be produced using a flat bed knitting machine, such as a Raschel knitting machine, or using a circular knitting machine. Methods for producing a hairnet precursor from other appropriate fabrics are known in the art, and any suitable method may be used to produce the hairnet precursor.

The yarn used to produce the hairnet precursor from which the hairnet is produced may be manufactured from natural or synthetic materials. Preferably, the yarn is a synthetic yarn, such as nylon, polyester, viscose, acrylic or polypropylene. More preferably, it is polyester. Natural fibres such as cotton may also be used. It has been found that the use of certain synthetic yarns, such as polyester, in the manufacture of a hairnet according to the invention is particularly advantageous as these yarns cling to hair. In use, the synthetic yarn attracts loose hairs which protrude through the fabric, thus preventing them from falling and contaminating the work area.

The fabric of the hairnet precursor has an elasticated edge portion, which allows the hairnet to be located and retained on the head. For example, an elastic material may be interwoven into the edge of the material so that the fabric may be fitted and retained in position on the head and the hair is restrained within. Conveniently, the hairnet precursor includes an elastic material that is incorporated into the fabric of the net, for example incorporated as part of a knitted or woven fabric. Preferably, the elastic material passes through the one or more cinch points and allows the flexible band to fit as tightly as desired around the head just beyond the hairline to restrain the hair.

In a second step in a method according to the invention, the hairnet precursor is positioned on a mount to splay out the fabric adjacent the cinch point so that the material clumped together at the cinch point is spread out. Desirably, the material of the cinch point is spread out horizontally and evenly over a short distance from the cinch point. Suitable mountings are blocks, for example of wood, metal and/or plastics which may be of any appropriate cross-section, for example rectangular, square or round. In one method, the hairnet precursor is positioned on a single block to splay out the cinch point over the surface of the block. In another method, the mount may comprise a number of blocks. In such a method, the hairnet precursor may be spread between two, three or four blocks. Further preferably, the blocks are circular in cross section and have the form of pins, and the hairnet precursor is located behind one of three pins.

In a preferred method according to the invention the blocks on which the hairnet precursor is mounted are circular in cross-section and are in the form of posts or pins. Preferably, the posts have a diameter of 0.1 to 8 cm, preferably 0.2 to 6 cm, most preferably 0.3 to 5 cm. Pins have a diameter typically less than 1 cm, for example 0.3 to 1 cm. Posts on which the cinch point is splayed out have a greater cross-section, for example 1 to 5 cm. Typically, the blocks are separated by a distance of 40 to 150 cm, preferably 40 to 116 cm, more preferably 86 to 96 cm.

It is desired to spread a cinch point of the hairnet precursor, preferably a single cinch point, so that the material clumped together at the cinch point is spread out as evenly as possible. In this arrangement, a first edge of the fabric will extend from one side of the cinch point and a second edge of the fabric will extend from the opposite side of the cinch point. The bunched fabric will fan out from the cinch point under a degree of tension provided by the mounting means. The spreading out of the fabric will cause the height and width of the cinch point to be reduced. The bunching of the cinch point gradually tapers into the main body of the fabric through a perimeter portion of the cinch point, which perimeter portion extends around the cinch point. In the perimeter portion there will be a slight gathering of material but this will be significantly reduced compared to the bulk of the gathered material at the cinch point itself.

In the next step in a method according to the present invention, the fabric is bound along a line of binding from the first edge of the fabric and passing around the perimeter portion of the cinch point to the second edge of the fabric on the opposite side of the cinch point. The term "binding" includes, as non-limiting examples, stapling, fusing, sonic welding, stitching or the like. For optimum results, the fabric is held flat and evenly gathered. In this way, the edges of the fabric extending from each side of the cinch point are connected by a partially circular binding, preferably stitching, passing around the perimeter of the cinch point.

When the line of binding is in place, the cinch point is removed, for example by cutting along a cutting line located between the cinch point and the line of binding, to form a hairnet comprising an elongated fan edge along the cutting line. The resulting hairnet maintains its integrity as the cutting line forms an elongated fan edge with the line of binding connecting and securing the first and second edge portions of the fabric on removal of the cinch point. Preferably, the hairnet has an elasticated edge portion extending from a first end of the elongated fan edge around a peripheral edge of the fabric to a second end of the elongated fan edge.

In a further preferred method according to the invention, the elongated fan edge of the hairnet is covered by a separate edging material. The material may be the same as or different than the fabric of the hairnet according to the desired presentation. Advantageously, the edging material is the same material as the fabric of the hairnet including, elasticated materials, stretch stitching and/or sewn with elasticated threads. It is applied as a separate cover strip. This may be carried out according to conventional seaming techniques known to those skilled in the art.

The hairnet precursor may itself be suitable for use as a hairnet, in particular a hairnet with a single cinch point. The invention further provides a method of making such a hairnet.

According to a third aspect, there is provided a method of manufacturing a hairnet free of a cinch point, the hairnet comprising a fabric with an elasticated edge portion, the method comprising the steps of a) Providing a band of fabric suitable for forming into a hairnet, the fabric having first and second elongated and elasticated side edges;
b) Forming a double hairnet section length by gathering the fabric together crosswise and securing the fabric into a first gathered point and a second gathered point at positions corresponding to the ends of the double hairnet section length, and severing the fabric adjacent to the first and second gathered points;
c) Mounting the double hairnet section length between two mounting blocks so that a mid-portion of the first elongated side edge of the fabric is mounted over a first block and a mid-portion of the second elongated side of the fabric is mounted over a second block so that the first and second gathered points are juxtaposed between the blocks;
d) Drawing an edge of the fabric mounted on the first block, at a point adjacent the first gathered point, towards an edge of the fabric mounted on the first block, at a point adjacent to the second gathered point;
e) Drawing an edge of the fabric mounted on the second block, at a point adjacent the first gathered point, towards an edge of the fabric mounted on the second post, at a point adjacent to the second gathered point;
f) Applying a cover fabric over the first and second gathered points of the fabric;
g) Forming a first line of binding, simultaneously securing the fabric to the cover fabric and securing the edges of the fabric mounted on the first block;
h) Forming a second line of binding, simultaneously securing the fabric to the cover fabric and securing the edges of the fabric mounted on the second block;
i) Cutting the fabric along a cutting line between the first line of binding and the first and second gathered points and along a cutting line between the second line of binding and the first and second gathered points; and
j) Securing the cover fabric over each cutting line to form first and second hairnets, each having an elongated fan edge.

Conveniently, the first and second lines of binding, when mounted on the blocks, are separated by a distance of 1-15 cm, more preferably 2-10 cm and particularly 2-6 cm. Typically, the lines of binding are 1-15 cm in length, preferably 2-6 cm and particularly 3 to 4 cm.

According to a fourth aspect of the invention, there is provided a hairnet without a cinch point, produced according to the herein-described methods.

According to a fifth aspect of the invention, there is provided a method of manufacturing a hairnet having a single cinch point, the hairnet comprising a fabric with an elasticated edge portion, the method comprising the steps of a) Providing a band of fabric suitable for forming into a hairnet, the fabric having first and second elongated and elasticated side edges;
b) Forming a double hairnet section length by gathering the fabric together crosswise and securing the fabric into a first gathered point and a second gathered point at positions corresponding to the ends of the double hairnet section length, and severing the fabric adjacent to the first and second gathered points;
c) Mounting the double hairnet section length between two mounting blocks so that a mid-portion of the first elongated side edge of the fabric is mounted over a first block and a mid-portion of the second elongated side of the fabric is mounted over a second block so that the first and second gathered points are juxtaposed between the blocks;
d) Drawing an edge of the fabric mounted on the first block, at a point adjacent the first gathered point, towards an edge of the fabric mounted on the first block, at a point adjacent to the second gathered point, and securing the edges to form a cinch point of a first hairnet;
e) Drawing an edge of the fabric mounted on the second block, at a point adjacent the second gathered point, towards an edge of the fabric mounted on the second block, at a point adjacent to the second gathered point, and securing the edges to form a cinch point of a second hairnet; and
f) Cutting the fabric between the cinch points and the gathered points to form first and second hairnets, each having a single cinch point.

The gathered points and cinch points may be made by methods known to those familiar in the art such as but not limited to stitching, inserting a metal gathered clip or staple, sonic welding, fusing or tying etc.

Typical fabrics for the hairnet and the means for incorporating a flexible band into each elongated side length are described hereinabove.

In step (b), a sufficient length of fabric is taken to provide for two hairnets.

In step (c), the blocks may be as described for the mounting for the splaying out of the cinch point, especially as posts of 1 to 5 cm diameter. The hairnet is symmetrically mounted between the two posts so that the first and second gathered points are directly opposing each other. This ensures that the first and second hairnets are identical when released from the mounting.

Conveniently, in the method the fabric is cut between the first and second gathered points and the cinch point of each hairnet to form first and second hairnets, each having a single cinch point.

The method according to the fifth aspect of the invention may precede the method of the second aspect, i.e. the hairnet with a single cinch point produced in the former method may be the hairnet precursor that is the starting material for the latter.

DETAILED DESCRIPTION OF THE EMBODIMENTS

Figure 1:
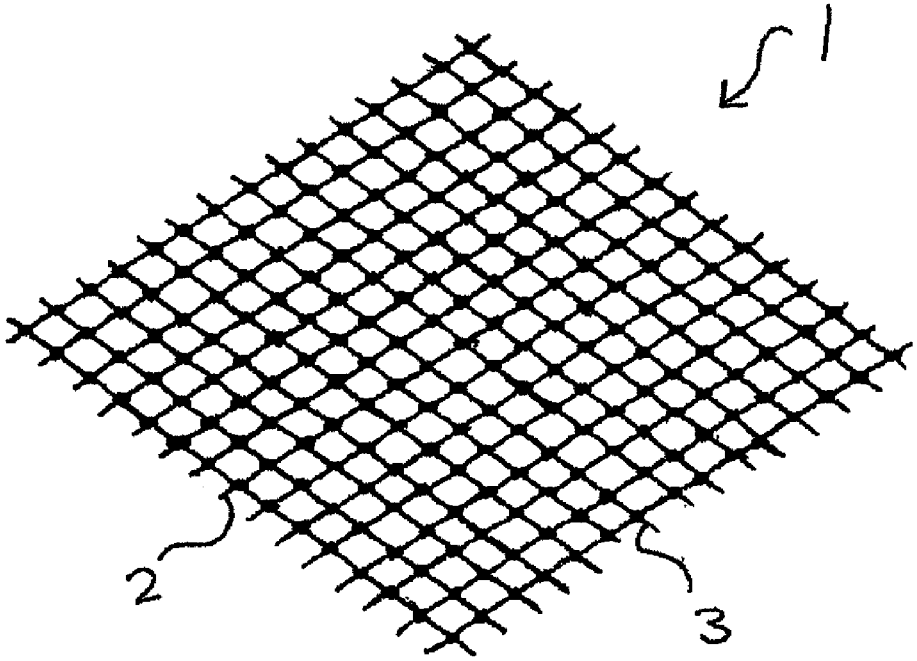
FIG. 1 is a fragmentary view that shows the structure of a knitted fabric used in the manufacture of a conventional hairnet.

Referring firstly to FIG. 1, hairnets 1 of the present invention are produced from knitted fabric having an open mesh structure that is essentially the same, whether viewed along the stitching line labelled 2 or along the transverse stitching line labeled 3.

Figure 2:
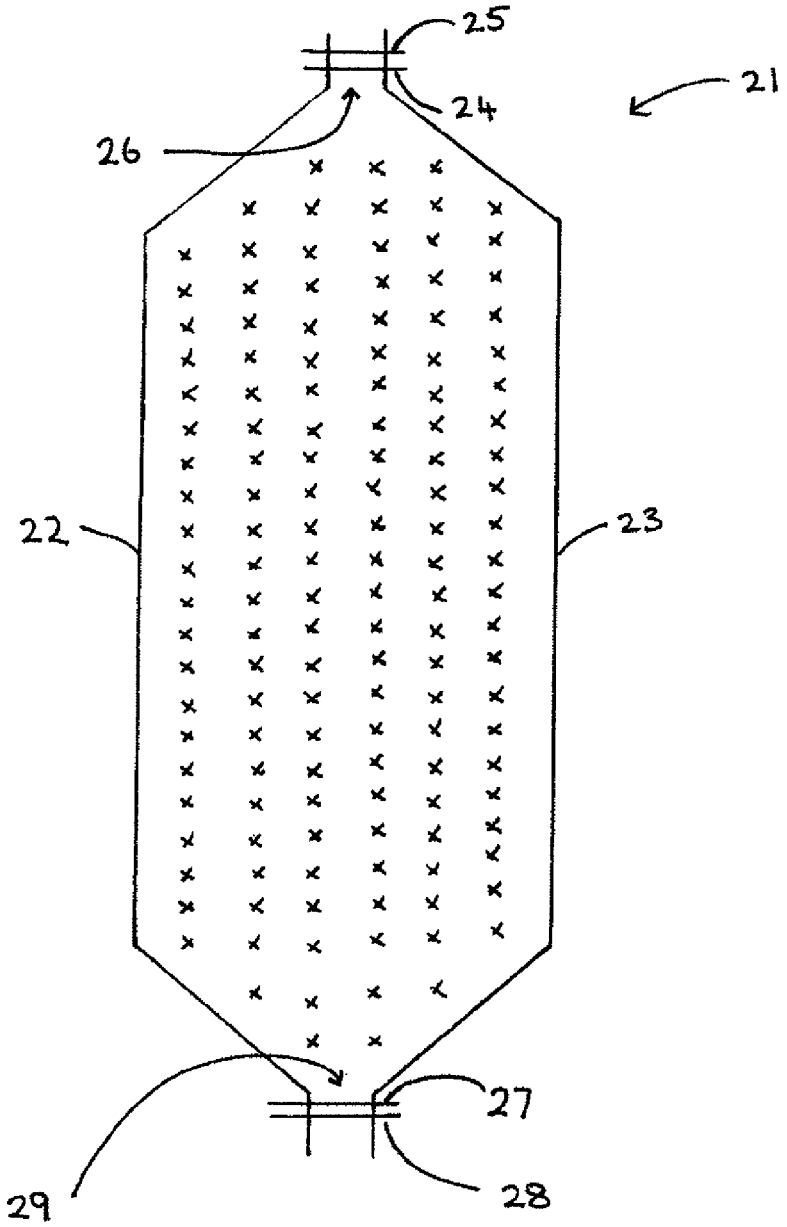
FIG. 2 is a schematic view of a double hairnet segment of a continuous length of fabric used in the manufacture of a hairnet according to the invention.

Referring to FIG. 2, a hairnet according to the invention is manufactured by knitting a continuous band of fabric. The fabric incorporates an elastic yarn at (or close to) its edges 22, 23. In FIG. 2, the lines xxxxxxx represent the lines of stitches in the open mesh structure in FIG. 1. FIG. 2 is of course schematic and the number of such lines of stitches is in reality much greater than that depicted.

The continuous band of fabric is divided into lengthwise segments 21, each segment corresponding to the material required for two hairnets. The fabric is provided as discrete lengths as shown in FIG. 2. The fabric segment is fashioned by drawing the elongated side edges 22, 23 of the continuous band of fabric together at a desired cutting point and stitching across the width of the fabric, making sure that all the net is encapsulated within the transverse stitching 24. A second transverse stitching 25 is repeated adjacent the first stitching and the fabric then cut in the section between the first and second transverse stitching. The transverse stitching forms a first gathered point 26 of the fabric segment. The same procedure is repeated with two lines of stitching 27, 28 at another desired cutting point of the continuous band of material to form a second gathered point 29 of the fabric segment, the length of the of the fabric segment representing a double length of material for forming into two hairnets.

Figure 3:
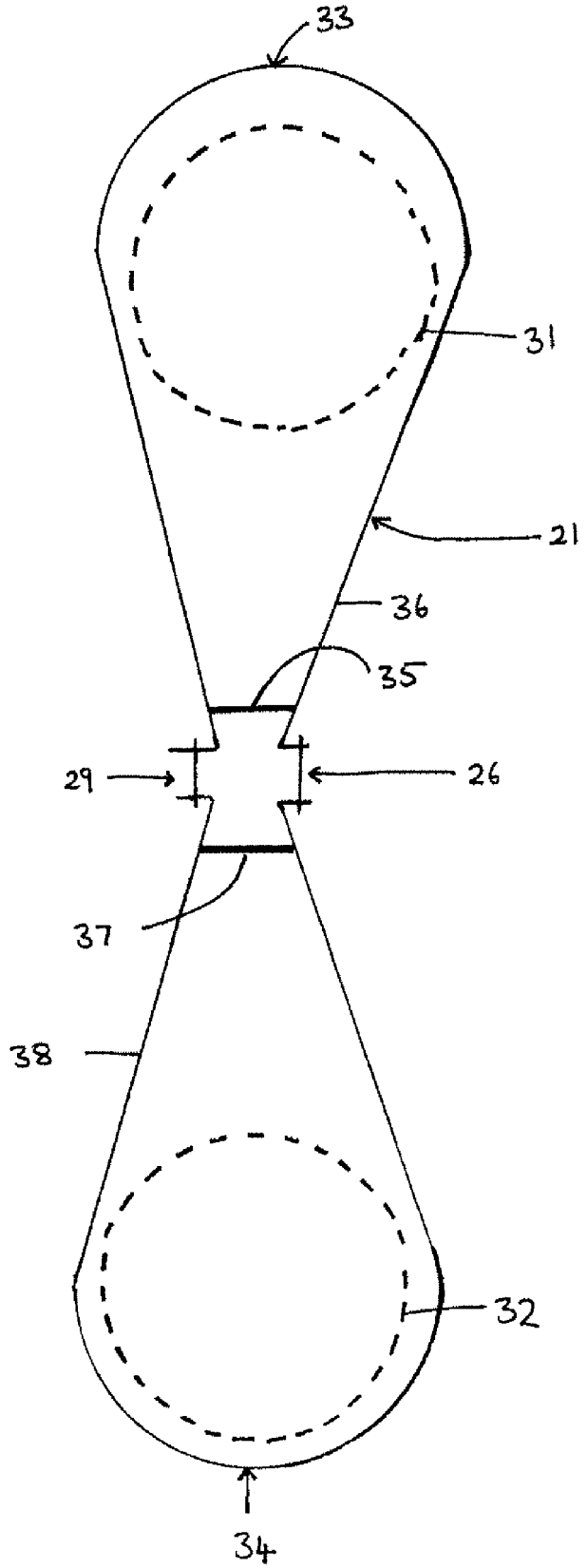
FIG. 3 shows a plan view for mounting the segment for formation into a double hairnet with a single cinch point.

As shown in FIG. 3, the double length of fabric 21 is mounted on two adjacent posts 31,32 so that a mid-portion 33 of the first elongated side of the material is mounted over the first post and a mid-portion 34 of the second elongated side of the fabric is mounted over the second post, ensuring that the first and second gathered points 26, 29 are facing each other in a middle area between the posts 31,32. The two elongated edges of the fabric are drawn together on each side of the first and second gathered points 26, 29 (which face each other) and stitched to form cinch point 35 of hairnet 36 and cinch point 37 of hairnet 38. The hairnets 36, 38 are separated by cutting between the cinch point 35 and first and second gathered points 26,29 and between the cinch point 37 and first and second gathered points 26, 29. Hairnets 36, 38 are thus formed having only one cinch point each. Such a manufacturing method to provide a single cinch point significantly contributes to the comfort of the wearer as clumping of the fabric only occurs at a single point of the hairnet.

Figure 4:
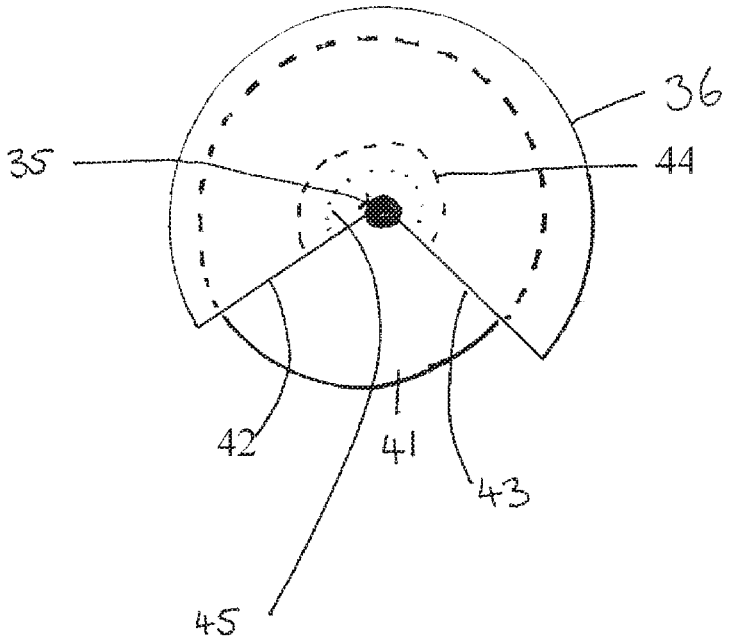
FIG. 4 is a plan view of the cinch point of a hairnet precursor mounted on a post.

As shown in FIG. 4, hairnet 36 is mounted on block 41 by placing the cinch point 35 over the center of the block and stretching the fabric to fan out the clumped material at the cinch point evenly over the end of the block. The fabric is bound along a line by stitching from the first edge 42 of the fabric passing around the perimeter of the cinch point to a second edge 43 of the fabric on the opposite side of the cinch point as shown by a dashed line 44. The cinch point 35 is cut away from the fabric along dotted line 45 and disposed of.

Figure 5:
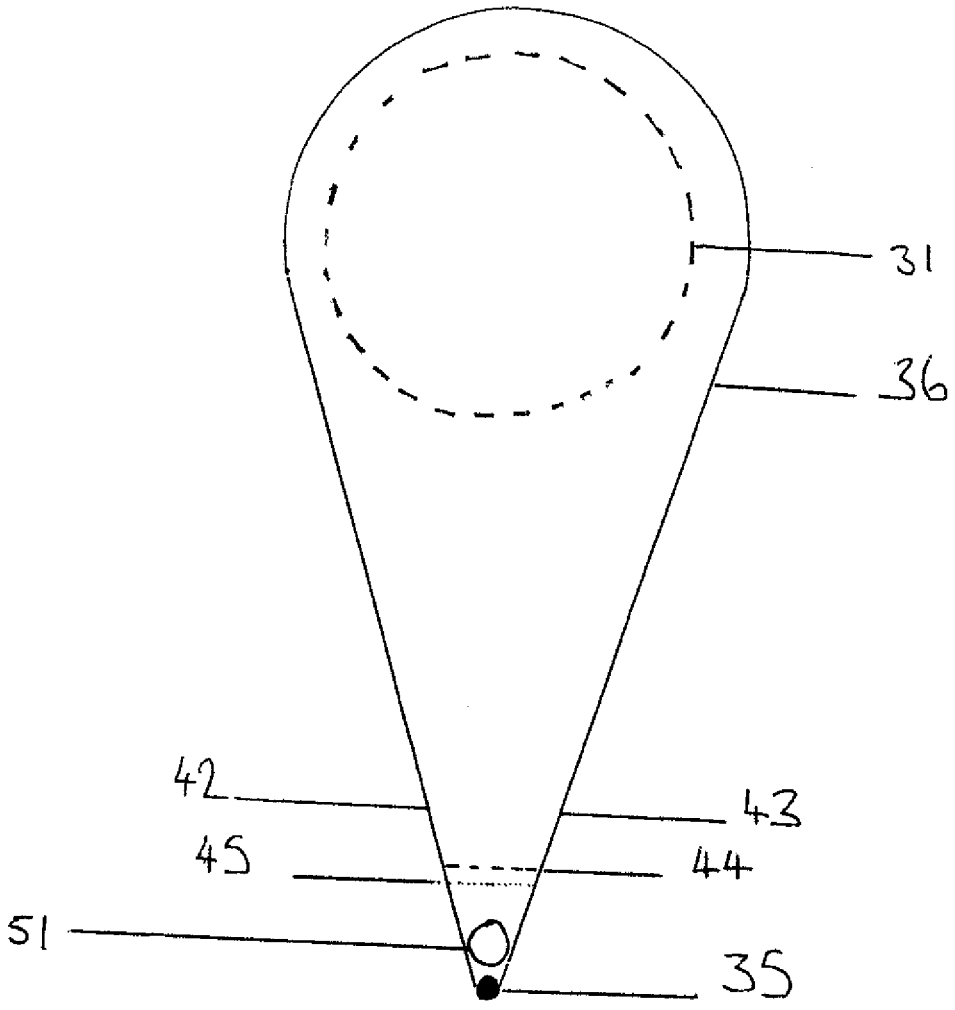
FIG. 5 is a plan view of a hairnet precursor mounted between a pin and a post.
Figure 6:
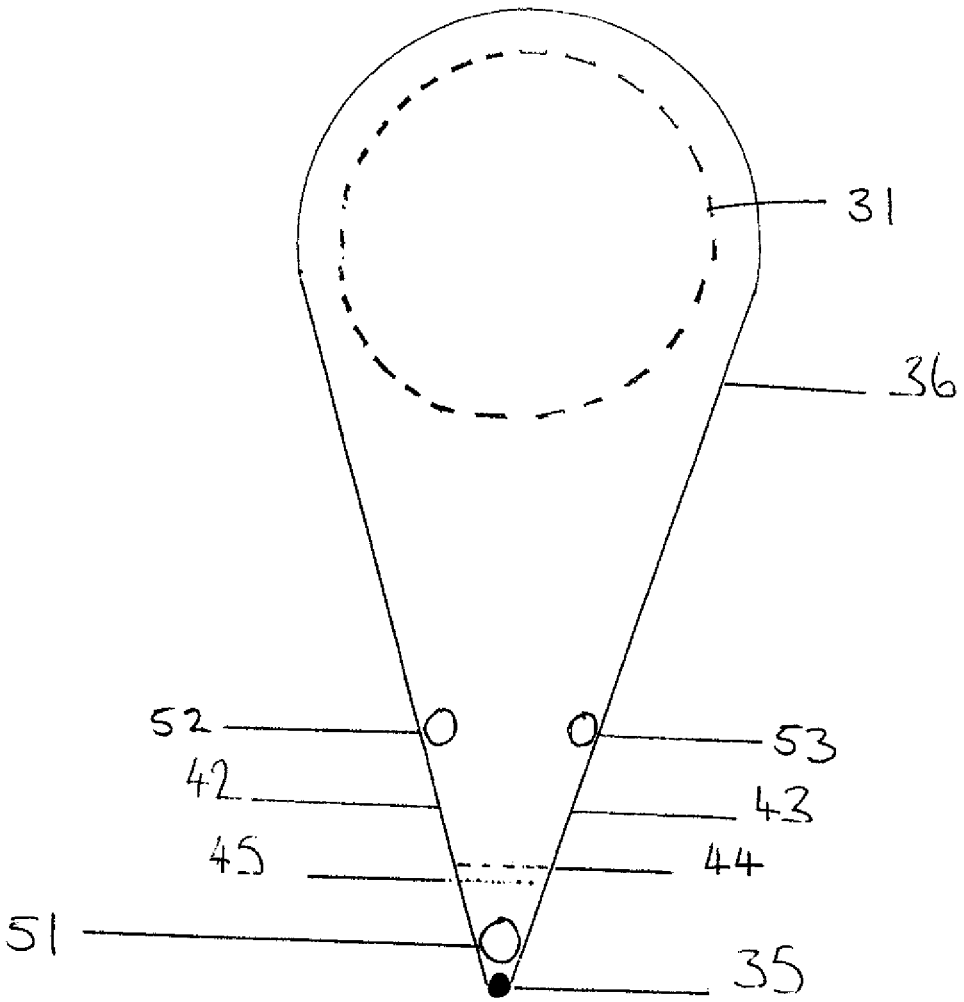
FIG. 6 is a plan view of a hairnet precursor between three pins and a post.
Figure 7:
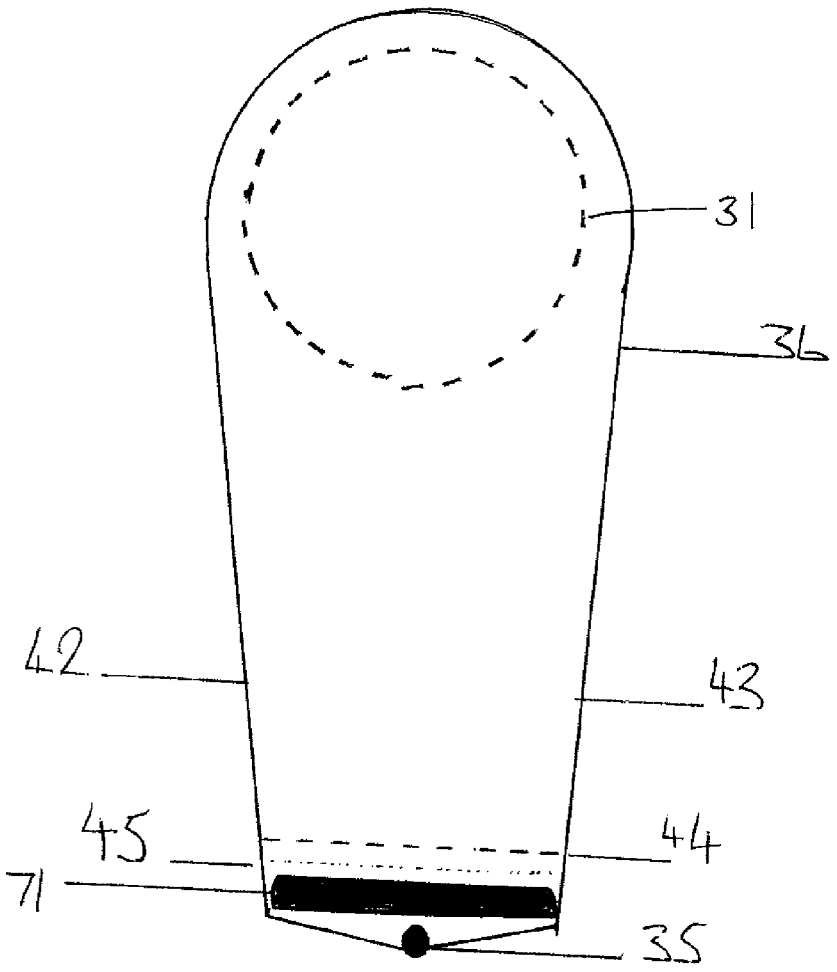
FIG. 7 is a plan view of a hairnet precursor between a block and a post.

Additional embodiments relating to the preparation of a hairnet free of a cinch point as shown in FIGS. 5 to 7 will now be described.

Referring to FIG. 5, a hairnet 36 with a cinch point 35 is mounted on post 31 with the edge portion of the hairnet on the opposite side to the cinch point 35 mounted on the post. The cinch point 35 is mounted on a pin 51 with the cinch point 35 located behind the pin 51 as shown in FIG. 5. A portion of the cinch point may extend over the top of the pin 51, but the majority of the cinch point will lie behind the pin to maintain tension. The fabric is bound along a line of stitching as shown by dashed line 44. The stitching is performed by a sewing machine. The cinch point 35 is cut away with scissors from hairnet 36 along dotted line 45 and disposed of.

Referring to FIG. 6, this is a similar arrangement to that described in FIG. 5, with cinch point 35 behind pin 51 with the addition of two extra pins 52, 53. These pins serve to increase the tension on the hairnet to optimize the splaying out of the cinch point. The pins 51, 52, 53 are located so that they do not interfere with the operation of the sewing machine as it sews along line 44. As described in FIG. 5, the cinch point 35 is cut away from the hairnet along dotted line 45 and disposed of.

Referring to FIG. 7, the hairnet 36 is mounted over post 31 so that cinch point 35 is behind block 71 so that the hairnet is under tension. As described above, the sewing machine sews along line 44 and the cinch point is removed by cutting along line 45.

Figure 9:
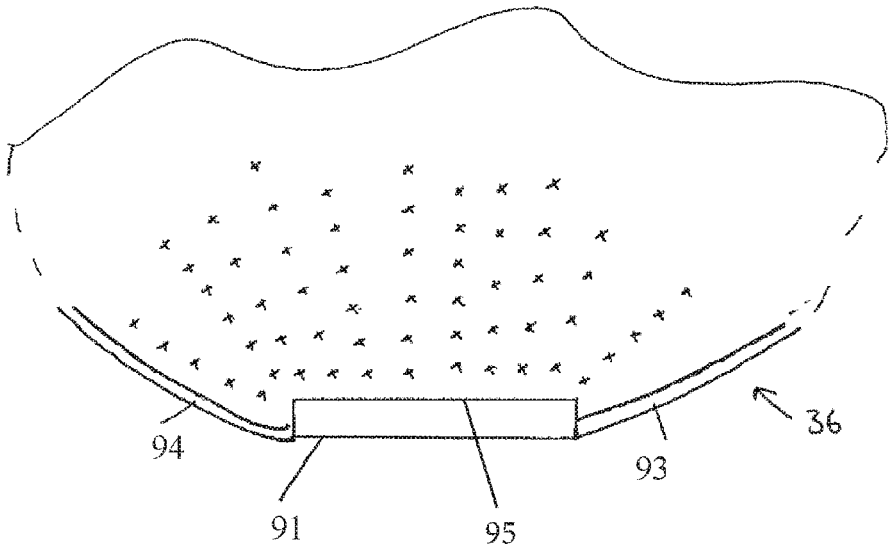
FIG. 9 is a diagrammatic view of the elongated fan point of a hairnet according to the present invention.

As shown in FIG. 9, a separate strip of material 91, 5 cm in length, is applied across the newly formed edge (the dotted line of FIG. 4) of the hairnet 36 to secure the ends of the flexible elasticated bands 93, 94 and to form an elongated fan edge. The edge may be finished by covering with a cover seam 95 which is folded over & twisted over the edge and secured by stitching. Such a manufacturing method to provide an elongated fan edge removes the depth of clumping at the cinch point and significantly contributes to the comfort of the wearer particularly when it is worn under a tightly fitting hard helmet or cap.

Figure 8:
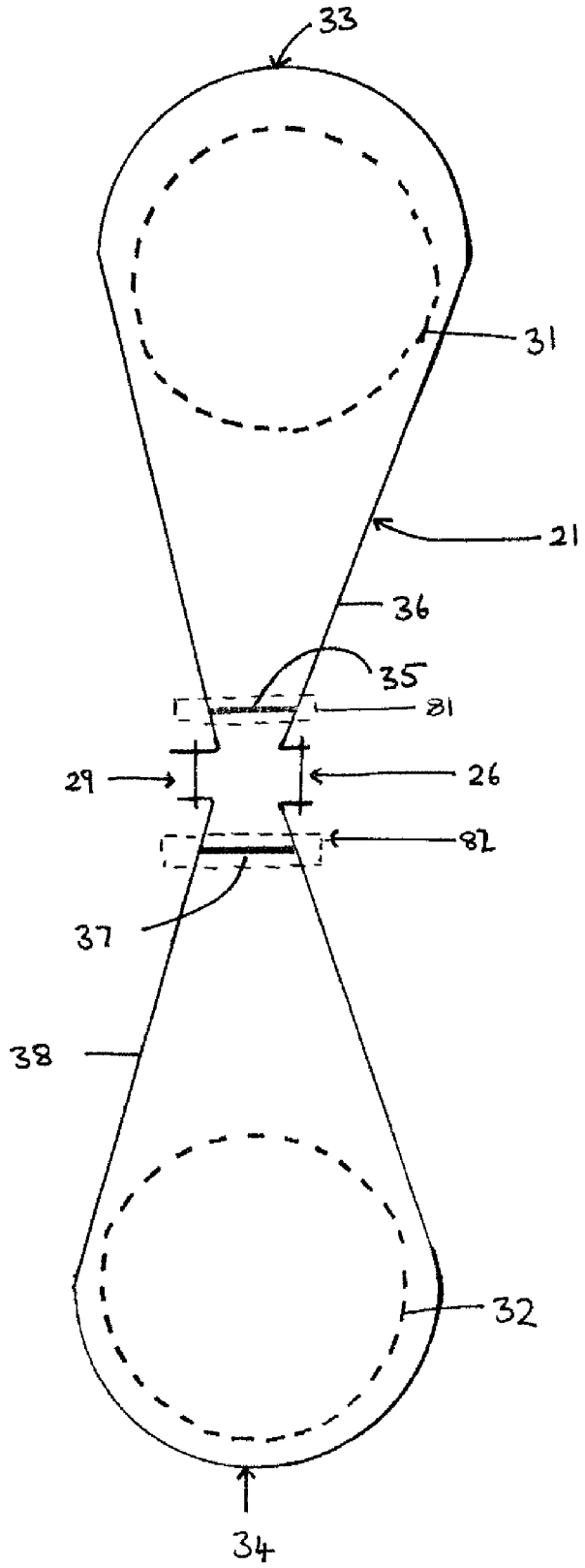
FIG. 8 shows a plan view for mounting a double hairnet segment for formation into a two hairnets, each with an elongated fan edge.

An alternative production of a hairnet free of a cinch point is now described with reference to FIG. 8. The double length of fabric for forming into two hairnets, as described above, is mounted on adjacent posts 31, 32 as hereinabove described so that the first and second gathered points 26, 29 are juxtaposed. Separate cover fabric is overlaid in the area of the gathered points as shown in FIG. 8. A line of stitching is applied at line 35 transversely connecting the first edge portion and a second edge portion of hairnet and securing a separate fabric cover 81 to the hairnet precursor. Approximately, 1 cm of the cover fabric extends at each end of the stitching line 35. A separate line of stitching is applied at line 37 transversely connecting the first edge portion and a second edge portion of hairnet and securing a separate fabric cover 82 to the hairnet precursor. Approximately, 1 cm of the cover fabric extends at each end of the stitching line 37. The lines of stitching 35, 37 are approximately 3 cm apart.

The cover fabric secures the stitch line, it secures the elastic on each side of the hairnet and also secures the fabric and maintains an even and constant gather. The fabric is cut near the line of binding 35, 37 between the line of binding and the gather points 26, 29. A small portion of the cover fabric extending beyond the stitching line is secured over the cutting edge to finish the seam and the remainder disposed of. The cover fabric forms an elongated edge.

What is claimed is:

1. A method of producing a hairnet free of a cinch point, the method comprising the steps of:

a) providing a hairnet precursor having a cinch point, the hairnet precursor comprising fabric with an elasticated edge portion, wherein fabric of the hairnet precursor is bunched together at the cinch point;

b) positioning the hairnet precursor on a mount to splay out fabric adjacent the cinch point so that fabric bunched together at the cinch point is spread out over the mount with a first and second edge of the fabric extending from each side of the cinch point;

c) binding the fabric of the hairnet precursor in a line of binding extending around a perimeter portion of the cinch point from the first edge of the fabric to the second edge of the fabric; and d) removing the cinch point along a cutting line located between the cinch point and the line of binding to form a hairnet comprising an elongated fan edge along the cutting line.

2. The method according to claim 1, wherein the hairnet precursor comprises a single cinch point.

3. The method according to claim 1, wherein the fabric is a knitted fabric.

4. The method according to claim 1, wherein the mount is made from a plastics material, metal or wood.

5. The method according to claim 1, wherein the mount comprises a single block.

6. The method according to claim 1, wherein the mount is configured as one or more posts having a diameter of 1 to 8 cm.

7. The method according to claim 1, wherein the mount comprises three posts.

8. The method according to claim 6, wherein the posts are separated by a distance of 40 to 150 cm.

9. The method according to claim 1, wherein the elongated fan edge is covered by a separate edging material.

10. The method according to claim 1, wherein a flexible band is formed integrally with the fabric of the hairnet.

11. A method of manufacturing a hairnet having a single cinch point, the hairnet comprising a fabric with an elasticated edge portion, the method comprising the steps of:

a) providing a band of fabric suitable for forming into a hairnet, the fabric having first and second elongated and elasticated side edges;

b) forming a double hairnet section length by gathering the fabric together crosswise and securing the fabric into a first gathered point and a second gathered point at positions corresponding to the ends of the double hairnet section length, and severing the fabric adjacent to the first and second gathered points;

c) mounting the double hairnet section length between two mounting blocks so that a mid-portion of the first elongated side edge of the fabric is mounted over a first block and a mid-portion of the second elongated side of the fabric is mounted over a second block so that the first and second gathered points are juxtaposed between the blocks;

d) drawing an edge of the fabric mounted on the first block, at a point adjacent the first gathered point, towards an edge of the fabric mounted on the first block, at a point adjacent to the second gathered point, and securing the edges to form a cinch point of a first hairnet;

e) drawing an edge of the fabric mounted on the second block, at a point adjacent the second gathered point, towards an edge of the fabric mounted on the second post, at a point adjacent to the second gathered point, and securing the edges to form a cinch point of a second hairnet; and f) cutting the fabric between the cinch points and the gathered points to form first and second hairnets, each having a single cinch point.

12. The method according to claim 11, wherein the fabric is cut between the first and second gathered points and the cinch point of each hairnet to form first and second hairnets, each hairnet having a single cinch point.

13. A method of manufacturing a hairnet free of a cinch point, the hairnet comprising a fabric with an elasticated edge portion, the method comprising the steps of:

a) providing a band of fabric suitable for forming into a hairnet, the fabric having first and second elongated and elasticated side edges;

b) forming a double hairnet section length by gathering the fabric together crosswise and securing the fabric into a first gathered point and a second gathered point at positions corresponding to the ends of the double hairnet section length, and severing the fabric adjacent to the first and second gathered points;

c) mounting the double hairnet section length between two mounting blocks so that a mid-portion of the first elongated side edge of the fabric is mounted over a first block and a mid-portion of the second elongated side of the fabric is mounted over a second block so that the first and second gathered points are juxtaposed between the blocks;

d) drawing an edge of the fabric mounted on the first block, at a point adjacent the first gathered point, towards an edge of the fabric mounted on the first block, at a point adjacent to the second gathered point;

e) drawing an edge of the fabric mounted on the second block, at a point adjacent the first gathered point, towards an edge of the fabric mounted on the second post, at a point adjacent to the second gathered point;

f) applying cover material over the first and second gathered points of the fabric;

g) forming a first line of binding, simultaneously securing the fabric to the cover material and securing the edges of the fabric mounted on the first block;

h) forming a second line of binding, simultaneously securing the fabric to the cover material and securing the edges of the fabric mounted on the second block;

i) cutting the fabric along a cutting line between the first line of binding and the first and second gathered points and along a cutting line between the second line of binding and the first and second gathered points; and j) securing the cover material over each cutting line to form first and second hairnets, each having an elongated fan edge.

* * * * *